US008748073B2

(12) United States Patent
Nagasawa et al.

(10) Patent No.: US 8,748,073 B2
(45) Date of Patent: Jun. 10, 2014

(54) TONER, MANUFACTURING METHOD THEREOF AND IMAGE FORMING METHOD

(71) Applicants: Hiroshi Nagasawa, Tokyo (JP); Ken Ohmura, Tokyo (JP)

(72) Inventors: Hiroshi Nagasawa, Tokyo (JP); Ken Ohmura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/963,452

(22) Filed: Aug. 9, 2013

(65) Prior Publication Data

US 2013/0323639 A1 Dec. 5, 2013

Related U.S. Application Data

(62) Division of application No. 13/529,043, filed on Jun. 21, 2012.

(30) Foreign Application Priority Data

Jun. 28, 2011 (JP) ..... 2011-142632

(51) Int. Cl.
*G03G 5/00* (2006.01)

(52) U.S. Cl.
USPC ..... 430/137.14; 430/137.11; 430/110.2

(58) Field of Classification Search
USPC ..... 430/110.2, 137.11, 137.14
See application file for complete search history.

(56) References Cited

U.S. PATENT DOCUMENTS

| | | | | |
|---|---|---|---|---|
| 8,029,961 | B2 | 10/2011 | Kuramoto et al. | |
| 8,034,521 | B2 | 10/2011 | Kuramoto et al. | |
| 8,383,313 | B2 | 2/2013 | Ayaki et al. | |
| 2005/0175922 | A1* | 8/2005 | Fujino et al. | 430/110.2 |
| 2006/0057483 | A1 | 3/2006 | Yanase et al. | |
| 2009/0170019 | A1 | 7/2009 | Kuramoto et al. | |
| 2010/0178606 | A1 | 7/2010 | Kouyama et al. | |
| 2011/0081609 | A1 | 4/2011 | Ayaki et al. | |
| 2011/0159425 | A1* | 6/2011 | Itabashi et al. | 430/108.2 |
| 2012/0172562 | A1 | 7/2012 | Kenmoku et al. | |

FOREIGN PATENT DOCUMENTS

| | | |
|---|---|---|
| JP | 05-027478 | 2/1993 |
| JP | 2002-318470 | 10/2002 |
| JP | 2002-351147 | 12/2002 |
| JP | 2007-133200 | 5/2007 |
| JP | 2009-168963 | 7/2009 |
| JP | 2009-186724 | 8/2009 |
| JP | 2010-271715 | 12/2010 |
| JP | 2011-095736 | 5/2011 |
| WO | 2007/055416 | 5/2007 |

OTHER PUBLICATIONS

Japanese Office Action, Notice of Reasons for Refusal, Patent Application No. 2011-142632, date mailed: Sep. 10, 2013 (3 pages).
English translation of Japanese Office Action, Notice of Reasons for Refusal, Patent Application No. 2011-142632, date mailed: Sep. 10, 2013 (4 pages).

* cited by examiner

*Primary Examiner* — Stewart Fraser
(74) *Attorney, Agent, or Firm* — Lucas & Mercanti, LLP

(57) ABSTRACT

A toner comprising a modified polyester resin containing a structure represented by Formula (1a) or (1b), wherein, in Formula (1a) and (1b), $R^1$ represents a hydrogen atom, a methyl group, or an ethyl group, $R^2$ represents an aliphatic hydrocarbon which may be branched, or an aromatic hydrocarbon, and $R^3$ represents a hydrogen atom, an alkyl group having 1 to 4 carbon atoms, or a phenyl group.

Formula (1a)

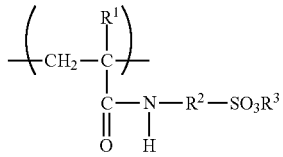

Formula (1b)

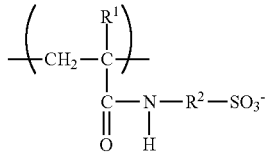

4 Claims, No Drawings

TONER, MANUFACTURING METHOD THEREOF AND IMAGE FORMING METHOD

This application is a Divisional Application of U.S. application Ser. No. 13/529,043 filed Jun. 21, 2012, which claimed the priority of Japanese Patent Application No. 2011-142632 filed on Jun. 28, 2011 in Japanese Patent Office, the entire content of both Applications are hereby incorporated by reference.

FIELD OF THE INVENTION

The present invention related to: a toner used for image forming methods such as an electrophotographic method, an electrostatic recording method, an electrostatic printing method and a toner-jet method; a method of manufacturing the toner; and an image forming method employing the toner,

BACKGROUND OF THE INVENTION

In recent years, it has been more and more desired to output an image at a higher speed in the field of printers and copying apparatuses using an electrophotographic method. In order to increase the process speed of image formation, it is necessary to fully electrically charge a toner to stably develop an electrostatic latent image. In order to fully charge a toner, the friction charging property of a resin component of a toner have to be used. However, only by this method, since the amount of charge of a toner cannot be fully obtained, the initial rise of the density of an image becomes late, whereby a sufficient image density may not be obtained.

The needs for a toner which enables low-temperature fixing, so called a toner having a low-temperature fixing property, have become high not only from the view point of energy saving, since, when the process speed of image formation is increased, fixability is not securable if melting of the toner with a small quantity of heat is possible.

In Patent Documents 1, disclosed have been toner particles containing a polymer obtained by polymerizing at least a polymerizable monomer having a functional group selected from a group of a sulfonic acid group, a sulfonic salt group, a sulfonic acid ester group, and other polymerizale vinyl polymer, as a technology to prevent contamination of each member of a copying device and to obtain sufficient fixablity while stabilizing the charge property of the toner. However, the present inventors have revealed from our examination that, although certain effects can be recognized with the toner, further improvements are desired with respect to the low-temperature fixablility, the image density, and glossiness of the image.

On the other hand, in order to enable fixing at a lower temperature, use of a binder resin having a high sharp melt property in a toner has been known as one of the effective methods, and a polyester resin has been known to be excellent to have such a property (for example, refer to Patent Documents 2).

Accordingly, it is motivated to introduce a polymerizable monomer having a functional group selected from a group of a sulfonic acid group, a sulfonic salt group, a sulfonic acid ester group into a polyester resin (for example, refer to Patent Documents 3 and Patent Documents 4). However, the present inventors have revealed from our examination that, in the conventional method, it has been necessary to copolymerize such a polymerizable monomer with styrene and an acrylic ester, and then to mix in the toner in the manufacturing process of the toner particles, which cause notably low productivity.

On the other hand, a technique to hybridize a polyester resin and a radically polymerizable monomer to achieve sufficient elasticity at higher temperatures has been disclosed (for example, refer to Patent Document 5).

Patent Documents 1: Japanese Patent Application Publication Open to Public Inspection (hereafter referred to as JP-A) No. 2009-168963

Patent Documents 2: JP-A No. 5-027478

Patent Documents 3: JP-A No. 2002-351147

Patent Documents 4: JP-A No. 2010-271715

Patent Documents 5: JP-A No. 2011-095736

SUMMARY OF THE INVENTION

An object of the present invention is to provide a toner causing negligible reduction of the image density and providing high glossiness even in a high speed image forming apparatus.

Another object of the present invention is to provide a highly productive method of manufacturing the toner, by which the toner can be efficiently manufactured with a smaller number of steps.

Another object of the present invention is to provide an image forming method employing the toner.

One of the aspects to achieve the above objects is a toner comprising a modified polyester resin containing a structure represented by Formula (1a) or (1b), Formula (1a)

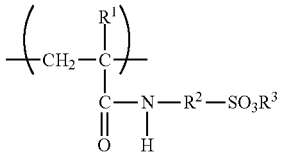

Formula (1b)

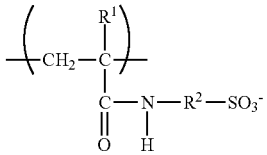

wherein, in Formula (1a) and (1b), $R^1$ represents a hydrogen atom, a methyl group, or an ethyl group, $R^2$ represents an aliphatic hydrocarbon which may be branched, or an aromatic hydrocarbon, and $R^3$ represents a hydrogen atom, an alkyl group having 1 to 4 carbon atoms, or a phenyl group.

DESCRIPTION OF THE PREFERRED EMBODIMENTS

The above objects of the present invention are achieved by the following structures.

1. A toner comprising a modified polyester resin containing a structure represented by Formula (1a) or (1b), Formula (1a)

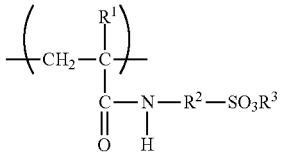

-continued

Formula (1b)

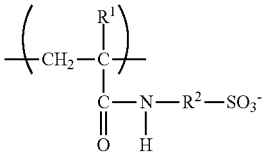

wherein, in Formula (1a) and (1b), $R^1$ represents a hydrogen atom, a methyl group, or an ethyl group, $R^2$ represents an aliphatic hydrocarbon which may be branched, or an aromatic hydrocarbon, and $R^3$ represents a hydrogen atom, an alkyl group having 1 to 4 carbon atoms, or a phenyl group.

2. The toner of Item 1, wherein the modified polyester resin contains a structure represented by Formula (1a).

3. The toner of Item 1, wherein the modified polyester resin is prepared by reacting 100 parts by mass of an unsaturated polyester resin and 0.5 to 3 parts by mass of a compound represented by Formula (2), Formula (2)

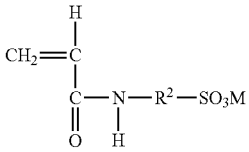

wherein, in Formula (2), $R^2$ represents an aliphatic hydrocarbon which may be branched or an aromatic hydrocarbon, and M represents an alkali metal, a hydrogen atom or a substituted or non-substituted hydrocarbon group.

4. The toner of any one of Items 1 to 3, wherein the toner has a core/shell structure, wherein a shell portion of the core/shell structure comprises the modified polyester resin containing a structure represented by Formula (1a) or (1b).

5. A method of manufacturing a toner comprising a modified polyester resin containing a structure represented by Formula (1a) or (1b), the method comprising the steps of:

(a): dissolving a polyester resin in a solvent to than a polyester resin solution;

(b): dispersing the polyester resin solution in an aqueous medium, followed by removing the solvent to form a polyester resin particle dispersion liquid;

(c): adding a polymerizable monomer having a functional group selected from a group of a sulfonic acid group, a sulfonic salt group, a sulfonic acid ester group, and a radical polymerization initiator to the polyester resin particle dispersion liquid, followed by conducting radical polymerization to form a modified polyester resin particle dispersion liquid containing modified polyester resin particles; and (d): carrying out aggregation using at least the modified polyester resin particles to form particles of the toner, Formula (1a)

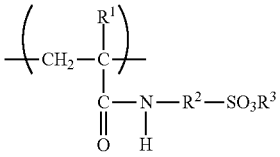

-continued

Formula (1b)

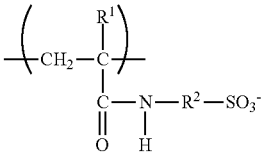

wherein, in Formula (1a) and (1b), $R^1$ represents a hydrogen atom, a methyl group, or an ethyl group, $R^2$ represents an aliphatic hydrocarbon which may be branched, or an aromatic hydrocarbon, and $R^3$ represents a hydrogen atom, an alkyl group having 1 to 4 carbon atoms, or a phenyl group, 6. The method of Item 5, wherein Step (d) further comprises the steps of:

dispersing colorant particles in an aqueous medium to form a colorant particle dispersion liquid, mixing the modified polyester resin particle dispersion liquid and a colorant particle dispersion liquid, and aggregating the modified polyester resin particles and the colorant particles to form particles of the toner.

7. The method of Item 5 or 6, wherein the polyester resin is an unsaturated polyester resin, and the polymerizable monomer is 0.5 to 3 parts by mass of a compound represented by Formula (2) based on 100 parts by mass of the unsaturated polyester resin, Formula (2)

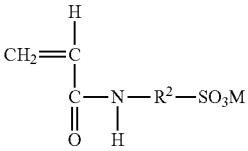

wherein, in Formula (2), $R^2$ represents an aliphatic hydrocarbon which may be branched or an aromatic hydrocarbon, and M represents an alkali metal, a hydrogen atom or a substituted or non-substituted hydrocarbon group.

8. The method of Item 5, wherein Step (d) further comprises the steps of:

forming the polyester resin particle dispersion liquid;

carrying out aggregation by adding an aggregation agent to the polyester resin particle dispersion liquid to form core particles, adding at least the modified polyester resin particle dispersion liquid prepared and an aggregation agent; and carrying out aggregation to than a shell layer on each core particle.

9. An image forming method employing the toner of any one of Items 1 to 4.

10. image forming method employing a toner manufactured by the method of any one of Items 5 to 8.

According to the above structures of the present invention, provided can be a toner causing negligible reduction of the image density and providing high glossiness even in a high speed image forming apparatus, a highly productive method of manufacturing the toner, by which the toner can be efficiently manufactured with a smaller number of steps, and an image forming method employing the toner.

In the present invention, a highly productive method of manufacturing the toner can be obtained, since at least one step can be omitted by directly graftizing the structure represented by Formula (1a) or (1b) (which is a structural unit) to a polyester resin, or by introducing the structure as a crosslinking group. Also, the degree of freedom with respect to the introduced amount of the structure is high because the modification of the polyester can be conducted in an aqueous medium, whereby the degree of freedom with respect to the design regarding the adjustment of the charged amount is high.

The reaction mechanism will be as follows: in an aqueous medium, a polymerizable monomer having a structure represented by Formula (1a) or (1b) is reacted via radical polymerization with an unsaturated structure originated from an unsaturated dicarboxylic acid (for example, fumaric acid) or an unsaturated divalent alcohol in the polyester resin to be incorporated in the polyester resin.

The toner of the present invention is characterized in that the toner contains a modified polyester resin which contains a structure represented by Formula (1a) or (1b). This is a technical feature common to the invention according to above Items 1 to 8.

As one of the embodiments of the present invention, the modified polyester resin which contains a structure represented by Formula (1a) or (1b) is preferably a resin obtained by reacting 100 parts by mass of an unsaturated polyester resin and 0.5 to 3 parts by mass of a compound represented by Formula (2), in view of exhibiting the effect of the present invention. Further, it is preferable that the toner of the present invention has a core/shell structure and the shell portion contains the modified polyester resin which contains a structure represented by Formula (1a) or (1b).

The method of manufacturing the toner of the present invention is characterized in that it is a method of manufacturing a toner containing a modified polyester resin which contains a structure represented by Formula (1a) or (1b) and that the method contains at least the above steps (a) to (c).

The method of manufacturing the toner of the present invention is preferably an embodiment containing the steps of mixing a dispersion liquid of the aforementioned modified polyester resin particles and a dispersion liquid of colorant particles, and aggregating the modified polyester resin particles and the colorant particles to form toner particles, and is preferably an embodiment containing the step of adding the aforementioned dispersion liquid of the modified polyester resin particles in the shell forming process to form toner particles having a core/shell structure.

The toner of the present invention can be preferably used in varieties of image forming methods, for example, an electrophotographic method, an electrostatic recording method, an electrostatic printing method and a toner-jet method.

The present invention, the constituting elements thereof and aspects and embodiments to carry out the present invention will be described in detail, below. In the present invention, "to" is used in the meaning that the values described before and after thereof are contained as the value of upper limit and the value of limit.

(Description of the Features of the Toner of the Present Invention and the Manufacturing Method Thereof)

The toner of the present invention is characterized in that the toner contains a modified polyester resin which contains a structure represented by Formula (1a) or (1b).

Formula (1a)

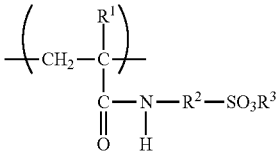

-continued

Formula (1b)

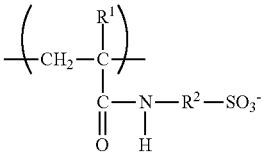

In Formula (1a) or (1b), $R^1$ represents a hydrogen atom, a methyl group, or an ethyl group, $R^2$ represents an aliphatic hydrocarbon which may be branched or an aromatic hydrocarbon, and $R^3$ represents a hydrogen atom, an alkyl group having 1 to 4 carbon atoms or a phenyl group.

As one of the embodiments of the present invention, the modified polyester resin which contains a structure represented by Formula (1a) (1b) is preferably a resin obtained by reacting 0.5 to 3 parts by mass of a compound represented by Formula (2) and 100 parts by mass of an unsaturated polyester resin, in view of exhibiting the effect of the present invention. The amount of the compound represented by Formula (2) of more than 3 parts by mass is riot preferred in view of the cost and the problem of aggregation rate in the manufacturing process.

Formula (2)

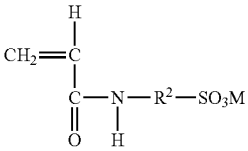

In the formula, $R^2$ represents an aliphatic hydrocarbon which may be branched or an aromatic hydrocarbon, and M represents an alkaline metal, a hydrogen atom or a substituted or non-substituted hydrocarbon group.

The substituted or non-substituted hydrocarbon group is not specifically limited, however, preferable are a methyl group, an ethyl group or a tert-butyl group.

Further, it is preferable that the toner of the present invention has a core/shell structure and the shell portion contains the modified polyester resin which contains a structure represented by Formula (1a) or (1b).

The method of manufacturing the toner containing a modified polyester resin which contains a structure represented by Formula (1a) or (1b) is characterized in that the method contains at least the following steps (a) to (c).

Step (a): polyester resin solution preparing step in which a polyester resin is dissolved in a solvent, Step (b): polyester resin particles dispersion liquid preparation step in which the aforementioned polyester resin solution is dispersed in an aqueous medium.

In this step, after the polyester resin solution dispersion liquid is prepared by dispersing the above polyester resin solution in an aqueous medium, the solvent is distilled away to obtain a polyester resin particles dispersion liquid. In this step, preferably, 85% or more of the used solvent is distilled away.

Step (c): the step to prepare modified polyester resin particle dispersion liquid containing the modified polyester resin particles, in which a polymerizable monomer having a functional group selected from a group of a sulfonic acid group, a sulfonic salt group, a sulfonic acid ester group and a radical polymerization initiator are added and the polyester resin particles and the polymerizable monomer in the dispersion liquid are reacted to form modified polyester resin particles.

The method of manufacturing the toner of the present invention is preferably an embodiment containing the steps of mixing a dispersion liquid of the aforementioned modified polyester resin particles and a dispersion liquid of colorant particles, and aggregating the modified polyester resin particles and the colorant particles to form toner particles, and is preferably an embodiment containing the step of adding the aforementioned dispersion liquid of the modified polyester resin particles in the shell forming process to form toner particles having a core/shell structure, in view of exhibiting the effect of the present invention.

In the manufacturing process of the toner, a release agent or an external additive is used, if necessary, in addition to the modified polyester resin particles containing a structure represented by Formula (1a) or (1b) and a colorant.

<Polyester Resin Containing a Structure Represented by Formula (1a) or (1b)>

The toner of the present invention is characterized in that a polyester resin containing a structure represented by Formula (1a) or (1b) is used as a binder resin or a material to be used in the shell.

<<Polyester Resin Particles and Dispersion Liquid Thereof>>

The polyester resin according to the present invention can be synthesized using varieties of alcohols and carboxylic acids as raw materials. For example, a polyester resin is preferably obtained via a polycondensation reaction of a polyalcohol and a polycarboxylic acid (namely, polyesterification) or via polycondensation of a hydroxycarboxylic acid (namely, polyesterification). It is specifically preferable in the present invention that an unsaturated polyester resin prepared by using, for example, an unsaturated polycarboxylic acid, an unsaturated polyalcohol or an unsaturated hydroxylcarboxylic acid is used.

The present invention is characterized in that the polyester resin contains a modified polyester resin containing a structure represented by Formula (1a) or (1b) at least in part.

As a polycarboxylic acid component according to the present invention, for example, fumaric acid, maleic acid, and itaconic acid are preferably used in cases when a reaction under existence of the monomer of above Formula (2) and a radical polymerization initiator is carried out.

Examples of such a polycarboxylic acid include: saturated aliphatic dicarboxylic acids such as oxalic acid, malonic acid, succinic acid, adipic acid, sebacic acid, azelaic acid, and n-dodecyl succinic acid; alicyclic dicarboxylic acids such as cyclohexane dicarboxylic acid; and aromatic dicarboxylic acids such as phthalic acid, isophthalic acid and terephthalic acid. These dicarboxylic acids may be used alone or in combination of two kinds or more.

Also, for example, an unsaturated hydroxycarboxylic acid monomer such as caffeic acid may be used as a monomer for forming a polyester to promote hybridization.

A polyester resin can be manufactured, for example, by carrying out polycondensation of the above alcoholic component and the carboxylic acid component at a temperature of 120 to 250° C. under inert gas atmosphere. An esterification catalyst known in the art may be used in the polycondensation, if necessary, Examples of a polyalcohol component include: aliphatic diols such as 1,2-propanediol, 1,3-propanediol, 1,4-butanediol, 1,5-pentanediol, 1,6-hexanediol, 1,7-heptanediol, 1,8-octanediol, neopentylglycol, and 1,4-butenediol; aromatic diols such as an alkyleneoxide adduct of bisphenol A; and polyalcohols of trivalent or more such as glycerin, pentaerythritol, trimethylolpropane and sorbitol. These alcohol components may be used alone or in combination of two kinds or more.

As a polyalcohol component, an unsaturated alcohol is preferably used to conduct the reaction under existence of a monomer of Formula (2) and a radical polymerization initiator.

As the unsaturated alcohol, alkene diols, more specifically, 2-butyne-1,4-diol, 3-butyne-1,4-diol and 9-octadecene-7,12-diol are preferably used to obtain the effect of the present invention.

<<Modified Polyester Resin>>

The modified polyester resin according to the present invention is characterized in that it contains a structure represented by aforementioned Formula (1a) or (1b) at least in part.

The present invention has a feature that a modified polyester resin particles dispersion liquid containing the modified polyester resin particles is prepared by adding a polymerizable monomer having a functional group selected from a group of a sulfonic acid group, a sulfonic salt group and a sulfonic acid ester group, and a radical polymerization initiator into a polyester resin particle dispersion liquid, and conducting a reaction between the above polyester resin particles in the dispersion liquid and the above polymerizable monomer to form modified polyester resin particles.

Examples of the above mentioned polymerizable monomer having a sulfonic acid group, a sulfonic salt group or a sulfonic acid ester group to manufacture aforementioned modified polyester resin particles include: 2-acrylamide-2-methylpropane sulfonic acid, 2-methacrylamide-2-methylpropane sulfonic acid, a sodium salt and a potassium salt thereof, an alkyl (having 1 to 4 carbon atoms) sulfonic acid ester compound, a benzenesulfonic acid ester compound, and a polymerizable monomer to form a sulfonic acid unit disclosed in paragraphs [0035] to [0038] of JP-A No. 2010-185907.

The aforementioned unit, namely, to structural unit of Formula (1a) or (1b) is contained in the molecule chain which is grafted at the unsaturated group of the polyester resin, which is, for example, originated from a fumaric acid. The aforementioned grafted molecular chain may also be bonded with a reactive group originated from the polymerizable monomers which will be described below, a polymerization initiator or a chain transfer agent.

The mixing ratio of "a polyester resin: a polymerizable monomer having a functional group selected from the group of a sulfonic acid group, a sulfonic salt group and a sulfonic acid ester group" is preferably 100:0.5 to 100:3. In the present invention, it is preferable to carry out a radical polymerization reaction among the aforementioned polyester resin, the aforementioned polymerizable monomer having a functional group selected from the group of a sulfonic acid group, a sulfonic salt group and a sulfonic acid ester group, and a polymerizable monomer which will be described below.

<Polymerizable Monomer>

Examples of a polymerizable monomer include: styrene; a methacrylic acid ester derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; an acrylic acid ester derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; an olefin such as ethylene, propylene and isobutylene; and a vinyl monomer of an acrylic acid derivative or a methacrylic acid derivative such as acrylonitrile, methacrylonitrile and acryl amide.

These vinyl monomers may be used alone or in combination of two kinds or more.

Of these, preferably used are styrene, butyl acrylate, 2-ethylhexyl acrylate, methyl methacrylate, methacrylic acid and acrylic acid. Styrene, butyl acrylate, 2-ethylhexyl acrylate each are a hydrophobic monomer, and, by using these monomers in combination, there are advantages to adjust the charging property or a glass transition point of the toner. Methacrylic acid and acrylic acid each have an advantage as a hydrophilic monomer to improve the dispersion stability of a dispersion liquid containing the resin particles including a polyester resin, whereby the aggregation diameter (namely, the diameter of aggregated particles) of the aforementioned resin particles becomes easier to control.

The polymerizable monomer containing acrylic acid or methacrylic acid has a dissociative functional group having an electric charge. By radically polymerizing the polyester resin with such a polymerizable monomer, the above dissociative functional groups are arranged of the surface of each polyester particle to form repulsive charge among the polyester resin particles, whereby the dispersion stability of the particles is improved. According to the improved dispersion stability of the particles, the diameter and the shape of the particles become easier to control since the aggregation rate of the polyester particles is reduced. In the present invention, varieties of diameters and shapes of the particles according to the purpose are available. Therefore, a sharp distribution of particle diameter and spherically shaped particles can be obtained due to the reduction the aggregation rate of the particles, whereby a transfer error can be prevented.

As a colorant, well-known colorants, such as carbon black, a magnetic material, a dye, and a pigment, may be used arbitrarily.

Examples of a black colorant include: carbon black such as furnace black and channel black; and magnetic powder such as magnetite and ferrite.

Examples of colored colorant include: pigments, for example, C. I. Pigment Red 5, C. I. Pigment Red 48:1, C. I. Pigment Red 53:1 C. I. Pigment Red 57:1, C. I. Pigment Red 81:4, C. I. Pigment Red 122, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222, C. I. Pigment Yellow 14, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, C. I. Pigment Yellow 185, C. I. Pigment Orange 31, C. I. Pigment Orange 43, C. I. Pigment Blue 15:3, C. I. Pigment Blue 60, C. I. Pigment Blue 76; and dyes, for example, C. I. Solvent Red 1, C. I. Solvent Red 49, C. I. Solvent Red 52, C. I. Solvent Red 58, C. I. Solvent Red 68, C. I. Solvent Red 11, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 69, C. I. Solvent Blue 70, C. I. Solvent Blue 93 and C. I. Solvent Blue 95. The colorants may be mixed to use. An acid metal salt or a benzylic acid metal complex may be cited.

It is preferable to add cerium oxide particles, titanate particles, a metal salt of a fatty acid having 20 to 50 carbon atoms, or higher alcohol particles in combination with hydrophobic silica or a hydrophobic metal oxide known in the art, from a viewpoint of enhancing, filming resistance. When cerium oxide particles or titanate particles are used, the number average particle diameter thereof is preferably 150 to 800 nm in view of enhancing filming resistance.

The releasing agent is not specifically limited, and those commonly known are usable. Examples of a releasing agent include: low molecular weight polyolefin such as polyethylene, polypropylene and polybutene; a synthesized ester wax; a vegetable wax such as carnauba wax, rice wax, candelilla wax, Japan tallow and jojoba oil; a mineral petroleum based wax such as montan wax, paraffin wax, microcrystalline wax and Fischer-Tropsch wax, and modified substances thereof.

Among the above releasing agents, a synthesized ester wax having a melting point of 70 to 95° C. is specifically preferably used in view of preventing filming. Examples of above synthesized ester wax include: behenyl behenate, pentaerythritol tetrabehenate and tribehenyl citrate. By using a synthesized ester wax such as behenyl behenate, pentaerythritol tetrabenhenate or tribehenyl citrate in combination with a paraffin wax having a melting point in the range of 75 to 100° C., enhancement in glossiness of a toner image and improvement of filming resistance can be both achieved.

When a paraffin wax having a melting point in the range of 75 to 100° C., among the paraffin waxes, is used, the offset property at a higher temperature region can be improved, even at any process speed from a lower speed region to a higher speed region. Further, a preferable blade cleanings property can be obtained when an image forming apparatus employing a cleaning blade as a cleaning means is used.

The content of these releasing agents is preferably in the range of 5 to 20% by mass, and more preferably in the range of 7 to 13% by mass based on the mass of the toner. When the content of the releasing agent is less than 5% by mass, offset may occur in the higher temperature region, and when it is more than 20% by mass, the releasing agent tends not be incorporated in the internal of the toner.

<Production Method of a Toner>

The method of manufacturing the toner containing a modified polyester resin which contains a structure represented by Formula (1a) or (1b) is characterized in that the method contains at least the following steps (a) to (c).

Step (a): polyester resin solution preparing step in which a polyester resin is dissolved in a solvent, Step (b): polyester resin particles dispersion liquid preparation step in which the aforementioned polyester resin solution is dispersed in an aqueous medium.

In this step, after the polyester resin solution dispersion liquid is prepared by dispersing the above polyester resin solution in an aqueous medium, the solvent is distilled away to obtain a polyester resin particles dispersion liquid. In this step, preferably, 85% or more of the used solvent is distilled away.

Step (c): the step to prepare modified polyester resin particles dispersion liquid containing the modified polyester resin particles, in which a polymerizable monomer having a functional group selected from a group of a sulfonic acid group, a sulfonic salt group, a sulfonic acid ester group and a radical polymerization initiator are added and the polyester resin particles and the polymerizable monomer in the dispersion liquid are reacted to form modified polyester resin particles.

The method of manufacturing the toner of the present invention is preferably an embodiment containing the steps of mixing a dispersion liquid or aforementioned modified polyester resin particles and a dispersion liquid of colorant particles, and aggregating the modified polyester resin particles and the colorant particles to form toner particles, and is preferably an embodiment containing the step of adding the aforementioned dispersion liquid of the modified polyester resin particles in the shell forming process to form toner particles having a core/shell structure, in view of exhibiting the effect of the present invention.

The method of manufacturing a toner of the present invention will be explained further in detail below.

Step (1): Resin Solution Preparing Step

This step is one in which a polyester resin is dissolved in an organic solvent to prepare a binder resin solution.

Examples of an organic solvent used in this step include: alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methylisobutyl ketone, ethylbutyl ketone, cyclohexanone and isoholon; ethers such as tetrahydrofuran, dimethyl ether, diethyl ether and dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate and diethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethylether acetate, diethylene glycol, diethylene glycol monomethyl ether, diethylene glycol monoethyl ether, diethylene glycol monopropyl ether, diethylene glycol monobutyl ether, diethylene glycol ethylether acetate, propylene glycol, propylene glycol monomethyl ether, propylene glycol monopropyl ether, propylene glycol monobutyl ether, propylene glycol methylether acetate and propylene glycol monobutyl ether; 3-methoxy-3 methyl butanol; 3-methoxy butanol; acetonitrile; dimethyl formamide; dimethyl acetamide; diacetone alcohol; and ethylaceto acetate. These solvents may be used alone or in combination of two kinds or more. Specifically preferable solvents include ethyl acetate and methylethyl ketone in view of the solubility and the drying property.

Step (2): Polyester Resin Particles Dispersion Liquid Preparation Step in which the Aforementioned Polyester Resin Solution is Dispersed in an Aqueous Medium.

This step is one in which, after the polyester resin solution dispersion liquid is prepared by dispersing the above polyester resin solution in an aqueous medium, the solvent is distilled away to obtain a polyester resin particles dispersion liquid. In this step, it is preferable that 85% or more of the used solvent is distilled away.

As the method of dispersion, a method to emulsify, by means of mechanical shearing power or a method to conduct phase-transfer emulsification may be cited.

In cases when a direct emulsification is conducted, a shearing power is applied to a mixed liquid of aqueous medium and a polyester solution or occasionally a mixed liquid containing the polyester and a colorant (also referred to as a polymer liquid). In this case, particles can be formed while reducing the viscosity of the polymer solution by heating. Also, a disperser may be added in order to stabilize the emulsified particles or to increase the viscosity of the aqueous medium.

Examples of an emulsifying device used in the above emulsification include: a homogenizer, a homomixer, an extruder and a media-dispersion apparatus.

As the size of the emulsified particles, it is preferable that the average diameter of the particles is in the range of 0.01 to 1 μm, and more preferably in the range of 0.03 to 0.3 μm. The heating temperature in the emulsification process may be selected according to the emulsifying state. When the emulsifying state is poor, the temperature may be increased. The emulsification may be conducted at temperatures between an ambient temperature and 100° C., however, the temperature is preferably in the range of 60 to 90° C.

Examples of a disperser used in the emulsification process include, water soluble polymers such as polyvinyl alcohol, methyl cellulose, ethyl cellulose, hydroxyethyl cellulose, carboxymethylcellulose, sodium polyacrylated and sodiumpolymethacrylate, surfactants, for example:

- anionic surfactants such as sodium dodecylbenzenesulfonate, sodium octadecylsulfate, sodium oleate, sodium laurate and potassium stearate,
- cationic surfactants such as laurylamine acetate, stearyl amine acetate and lauryl trimethyl ammonium chloride;
- amphoteric surfactants such as lauryl dimethyl amine oxide; and
- nonionic surfactants such as polyoxyethylene alkyl ether, polyoxyethylene alkyl phenyl ether and polyoxyethylene alkylamine, and inorganic salts, for example, tricalcium phosphate, aluminium hydroxide, calcium sulfate, calcium carbonate, barium carbonate.

Examples of a solvent used, if necessary, include:

- alcohols such as methanol, ethanol, propanol and butanol;
- polyalcohols such as ethylene glycol, propylene glycol, diethylene glycol and triethylene glycol;
- cellosolves such as methyl cellosolve and ethyl cellosolve;
- ketones such as acetone, methylethyl ketone and ethyl acetate;
- ethers such as tetrahydrofuran;
- hydrocarbons such as benzene, toluene and hexane; and
- water.

These solvents may be used alone of in combination of two kinds ore more.

The using amount of the aforementioned solvent is preferably in the range of 50 to 5000 parts by mass, and more preferably in the range of 120 to 1000 parts by mass, in a total amount of 100 parts by mass of polyester and other monomer added if necessary. It is also possible to incorporate a colorant in advance of the emulsification step.

As an example of a preparation method of a resin particle dispersion liquid according to a phase-transfer emulsification method, for example, the following method may be cited. Namely, a polyester resin is dissolved in a mixed liquid of organic solvent (a good solvent) and an aqueous solvent (a water soluble poor solvent) while a neutralizer (for example, ammonia) or a disperser may also be added, if necessary; a water soluble solvent (for example, water) is added while being agitated to form emulsified particles, and the solvent in the resin particle dispersion liquid is removed to obtain an emulsion. The adding order of a neutralizer and a disperser may be changed.

Examples of an organic solvent used in the phase-transfer emulsification method include: alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methylisobutyl ketone, ethylbutyl ketone, cyclohexanone and isoholon; ethers such as tetrahydrofuran, dimethyl ether, diethyl ether and dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate and diethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethylether acetate, diethylene glycol, diethylene glycol monomethyl ether, diethylene glycol monoethyl ether, diethylene glycol monopropyl ether, diethylene glycol monobutyl ether, diethylene glycol ethylether acetate, propylene glycol, propylene glycol monomethyl ether, propylene glycol monopropyl ether, propylene glycol monobutyl ether, propylene glycol methylether acetate and propylene glycol monobutyl ether; 3-methoxy-3methyl butanol; 3-methoxy butanol; acetonitrile; dimethyl formamide; dimethyl acetamide; diacetone alcohol; and ethylaceto acetate. These solvents may be used alone or in combination of two kinds or more.

Since the amount of a solvent for obtaining a desired particle diameter is different depending on the property of the resin, the amount of an organic solvent used in the phase-transfer emulsification method is difficult to be uniquely determined. When the amount of the solvent is excess, the production becomes inefficient since the amount of the solvent which must be removed in the later process increases, and, when the amount of the solvent is insufficient, the emulsification state becomes poor, resulting in larger diameters of the resin particles or a broader distribution of the diameters of the resin particles.

A phase-transfer emulsification method will now be explained. Emulsification is classified into three types, namely, natural emulsification, phase-transfer emulsification and forced emulsification, and an emulsified liquid obtained by the emulsification is called as an emulsion. In a case when the dispersed material is oily and the dispersion medium is aqueous, it is designated as an O/W type, and when the dispersed material is aqueous and the dispersion medium is oily, it is designated as a W/O type. Emulsion is classified into any one of an O/W type, namely, oil droplets in an aqueous medium, in which oil droplets are dispersed in an aqueous medium, and a W/O type, namely, aqueous droplets in an oily medium, in which aqueous droplets are dispersed in an oily medium. The phenomenon or the operation, in which an emulsion of aqueous droplets in an oily medium (namely, a W/O type) is prepared, first, and, then, it is changed to an emulsion of oily droplets in an aqueous medium (namely, an O/W type) is called as phase-transfer emulsification in the present invention.

In a case when a binder resin is dispersed in an aqueous medium, a part of or all of the carboxyl groups in the resin is preferably neutralized if necessary with a neutralizer. Examples of a neutralizer include: inorganic alkalis such as potassium hydroxide and sodium hydroxide; and amines such as ammonia, monomethylamine, dimethylamine, triethylamine, monoethylamine, diethylamine, triethylamine, mono-n-propyl amine, dimethyl-n-propyl amine, monoethanolamine, diethanolamine, triethanolamine, methylethanolamine, N-aminoethylethanolamine, methyldiethanolamine. monoisopropanolamine, diisopropanolamine, triisopropanolamine and N,N-dimethylpropanolamine. These neutralizers may be used alone or in combination of two kinds or more. By adding these neutralizers, the pH value in the emulsification process can be adjusted near the neutrality, whereby the hydrolysis of the polyester resin in the obtained polyester resin dispersion liquid can be prevented.

Also in the case of the phase-transfer emulsification, a dispersing agent may be added. Examples if a dispersing agent include, water soluble polymers such as polyvinyl alcohol, methyl cellulose, ethyl cellulose, hydroxyethyl cellulose, carboxymethylcellulose, sodium polyacrylated and sodiumpolymethacrylate, surfactants, for example:

anionic surfactants such as sodium dodecylbenzenesulfonate, sodium octadecylsulfate, sodium oleate, sodium laurate and potassium stearate, cationic surfactants such as laurylamine acetate, stearyl amine acetate and lauryl trimethyl ammonium chloride;

amphoteric surfactants such as lauryl dimethyl amine oxide; and nonionic surfactants such as polyoxyethylene alkyl ether, polyoxyethylene alkyl phenyl ether and polyoxyethylene alkylamine, and inorganic salts, for example, tricalcium phosphate, aluminium hydroxide, calcium sulfate, calcium carbonate, barium carbonate.

These dispersing agent may be used alone or in combination of two kinds or more. The amount of added neutralizer is preferably in the range of 0.01% by mass to 20% by mass based on the mass of the binder resin.

As for the emulsification temperature at the time of phase-transfer emulsification, it is preferable that the temperature is not more than the boiling point of the organic solvent and is not less than the melting point or the glass transition point of the hinder resin, in the case when the emulsification temperature is lower than the melting point cu the glass transition point of the binder resin, it becomes difficult to prepare a resin particles dispersion liquid. The emulsification may be conducted at a temperature higher than the boiling point of the organic solvent in a container which is pressurized and sealed.

The amount of resin particles contained in a resin particle dispersion liquid is preferably in the range of 5% by mass to 50% by mass, and more preferably in the range of 10% by mass to 40% by mass. When the amount of the resin particles is out of the above described range, the distribution of the diameters of the resin particles tends to be broadened to degrade the resulting property of the toner.

Regarding the polyester resin, it is preferable that the polyalcohol contains an unsaturated polyalcohol or the polycarboxylic acid contains an unsaturated polylcarboxilic acid. Fumaric acid and itaconic acid are specifically preferable because each of those exhibits a high radical polymerization property.

Step (3): The step to prepare modified polyester resin particle dispersion liquid containing the modified polyester resin particles, in which a radically polymerizable monomer having a functional group selected from a group of a sulfonic acid group, a sulfonic salt group, a sulfonic acid ester group and a radical polymerization initiator are added and the polyester resin particles and the polymerizable monomer in the dispersion liquid are reacted to form modified polyester resin particles.

In this step, a radical polymerization initiator is added into the polyester resin particle dispersion liquid obtained in above Step (2) to obtain a dispersion liquid containing the polyester resin particles being subjected to a polymerization reaction. In this case, a water-soluble polymerization initiator is preferably used. For example, water-soluble polymerization initiators of persulfate salts such as potassium persulfate and ammonium persulfate are preferably used to obtain the effect of the present invention. In a case when a process to dissolve a polyester resin in an organic solvent is contained in the polyester resin particle dispersion liquid preparing step, an oil-soluble polymerization initiator such as an alkyl peroxide may be added.

In order to adjust the molecular weight of a polymer, a chain transfer agent may be added.

Aforementioned Steps (1) to (3) are essential steps in the method of manufacturing a toner of the present invention. It is possible to manufacture a toner by separating polyester resin particles or modified polyester resin particles from the polyester resin particle dispersion liquid or modified polyester resin particle dispersion liquid in this stage, drying the obtained polyester resin, and conducting kneading•pulverizing to obtain a toner, however, it is preferable to conduct Steps (4) to (8) which will be described later, in order to obtain a smaller diameter toner exhibiting a sharp particle diameter distribution.

Step (4) Solvent Removing Step

In this step, the aforementioned organic solvent is removed to prepare a resin particle dispersion liquid. In this case, it is preferable to remove 99% or more of the solvent to easily control the core/shell structure in the toner manufacturing process.

As a method to remove the organic solvent, a method to heat the emulsion at a temperature in the range of 15 to 70° C. to evaporate the solvent, and a method to conduct depressurizing in combination to the above method are preferably carried out.

Step (5): Colorant Particle Dispersion Liquid Preparation Step in which a Colorant is Dispersed in an Aqueous Medium Oil droplets dispersion is carded out using mechanical energy. The dispersing apparatus is not specifically limited, and a stirring apparatus equipped with a high speed rotor, CLEARMIX (produced by M TECHNIQUE Co., Ltd.), an ultrasonic disperser, a mechanical homogenizer, cavitron, Mmanton-Gaulin homogenizer and a pressurizing homogenizer are usable.

The volume median diameter of the colorant particles prepared in this step is preferably in the range of 10 to 300 nm, more preferably in the range of 100 to 200 nm, and still more preferably in the range of 100 to 150 nm. The median diameter of the colorant particles can be controlled by, for example, adjusting the extent of the above mentioned mechanical energy.

Step 6: Step in which aggregation and fusion of resin particles and colorant particles are carried out to form a toner by adding an aggregation agent to an aqueous medium in which a dispersion of resin particles and a dispersion of colorant particles are mixed, and adjusting the temperature of the resulting liquid.

Examples of an aggregation agent include: an inorganic salt containing aluminum, an alkaline metal salt, an alkaline earth metal salt.

Examples of an inorganic salt containing aluminum include: metal salts such as aluminium chloride and aluminium sulfate; and inorganic metal salt polymers such as poly chloride and poly aluminium hydroxide.

Examples of an alkali metal include, lithium, potassium and sodium. Examples of an alkaline earth metal include: magnesium, calcium, strontium and barium. Of these, potassium, sodium, magnesium, calcium and barium are specifically preferable. Examples of a counter ion (namely, an anion which constitutes a salt) of aforementioned alkali metal or an alkaline earth metal include: a chloride ion, a bromide ion, an iodide ion, a carbonate ion and a sulfate ion.

It is also possible to use an organic solvent having a water soluble property, such as an alcohol, tetrahydrofuran, and ketone, as a flocculant.

In a case when a process to dissolve a polyester resin in an organic solvent is contained in the polyester resin particle dispersion liquid preparing step, the addition of an aggregation agent can be limited to a very small amount or can be eliminated when about 5 to 20% of the organic solvent is remained in the polyester particles, however, in this case, a step to remove the solvent from the toner particles becomes necessary, after the particles are aggregated to a prescribed diameter.

In a case when a release agent is added, a dispersion liquid of release agent particles (or a wax emulsion) may be added in this step into the aforementioned aqueous medium to conduct salting out and aggregation of the resin particles, colorant particles and release agent particles. Or, as described above, a dispersion liquid of a release agent or release agent particles may be added in aforementioned Step (1) or (2) to form a dispersion liquid of the resin particles and the release agent particles in advance, and may be aggregated in Step (6).

In a case when toner particles having a core/shell structure are formed, after an aggregation agent is added, a dispersion liquid of resin particles to be used for a shell is added in any stage of Step (6). Concretely it may be added while aggregating or after completion of aggregation and before fusing. Or, in a case when the aggregation process and the fusing process are conducted in parallel to simultaneously conduct the aggregation and fusion, it is preferable that the dispersion liquid of resin particles for shell is added after the core particles have grown to a prescribed particle diameter. In this case, an aggregation agent may be added together with a disperser of resin particles for shell forming, in order to prevent the resin particles for shell from aggregating themselves to form independent resin particles.

It is preferable that modified polyester resin particles prepared in Step (3) are used as a material to form the shell in view of enhancing the effect of the present invention. When the shell layer is formed with the modified polyester resin of the present invention, a common resin such as unmodified polyester, styrene-acrylic resin and the like may be used as a material to form the core.

More concretely, it is one of the preferable embodiments of the present invention that, after carrying out aggregation by adding an aggregation agent to an aqueous dispersion liquid containing at least polyester resin particles or unsaturated resin particles to form core particles, at least the modified polyester resin particle dispersion liquid prepared in above Step (3) and an aggregation agent are added and, by controlling the temperature, a shell layer was firmed on each core particle.

Step (7): Step to separate the toner particles from the aqueous medium by filtration and to remove unnecessary substance such as the surfactant from the toner particles via washing.

Step (8): Step to conduct drying of the toner particles after being subjected to washing.

Step (9): Step to add an external additive to the toner particles after being subjected to drying.

If necessary, an external additive, for example, hydrophobic silica or metal oxide particles are subjected to dry blending with the toner particles obtained in Step (7).

EXAMPLES

The present invention will be concretely explained with referring to examples below, however, the present invention is not limited thereto.

—Synthesis of Polyester Resin (A1)—

| <Composition> | |
|---|---|
| (Polycarboxylic acid monomer) | |
| Fumaric acid | 4.2 mass parts |
| Terephthalic acid | 78 mass parts |
| (Polyalcohol monomer) | |
| 2 mol propylene oxide adduct of 2,2-bis (4-hydroxyphenyl) propane | 52 mass pasts |
| 2 mol ethylene oxide adduct of 2,2-bis (4-hydroxyphenyl) propane | 48 mass parts |

Into a reaction vessel equipped with a stirring device, a nitrogen inlet pipe, a temperature sensor and a rectifying column, the above mentioned poly carboxylic acid component and the polyalcohol component were charged. The temperature within the system was raised to 190° C. taking one hour, after affirming that the inside of the system was stirred uniformly, catalyst $Ti(OBu)_4$ (in an amount of 0.006% by mass based on the total amount of polycarboxylic acid) was added.

The temperature within the system was raised to 240° C. taking 6 hours while distiling away the generated water, and polymerization reaction was conducted by continuing dehydration condensation reaction for 6 hours maintaining the temperature, and a Polyester resin (A1) was obtained.

When the molecular weight of obtained Polyester resin (A1) was measure via GPC (HLC-8 120GPC produced by ToSoh Corp., calibrated by styrene standard), the number average molecular weight was 3100.

—Preparation of Polyester Resin Particle Dispersion Liquid (A1)—

A resin particle dispersion liquid was prepared by using the resin obtained by "Synthesis of Polyester resin (A1)" which was coarsely pulverized using a hammer mill.

Into a reaction vessel equipped with an anchor wing which provide a stirring power, 180 parts by mass of methylethyl ketone and 60 parts by mass of isopropyl alcohol (IPA) were charged, the air inside the vessel was replaced with $N_2$ gas by introducing nitrogen gas.

Subsequently, 291 mass parts of Polyester resin (A1) was slowly added while heating the inside with an inside-oil bath device, followed by dissolving by stiffing.

After adding 20 parts by mass of 10% aqueous ammonia to the product, 1500 parts by mass of deionized water was added using a metering pump while stirring, and, when the emulsion exhibited a milky white color and the viscosity while stirring became low, the emulsification was considered to be ended.

Subsequently, the emulsion liquid was transferred, by pumping up due to a pressure difference based on centrifugal force, to a 3 liter separable flask equipped with stirring wings which forms a wet wall on the inner wall of the reaction vessel, a refluxing device and a depressurizing device using a vacuum pump, and the emulsion liquid was stirred under a condition of 58° C. of inner wall temperature of the reaction vessel and a reduced inside pressure of the reaction vessel of 8 kPa [abs]. The depressurizing was stopped when the refluxed amount reached 650 parts by mass, the inside pressure was recovered to an ambient pressure, and the liquid was cooled to an ambient temperature while stirring. The volume median diameter of the resin particles dispersed in obtained Polyester resin particle dispersion liquid (A1) was 162 nm.

—Preparation of Modified Polyester Resin Particle Dispersion Liquid (B1)—

Into 2100 parts by mass of above obtained Polyester resin particle dispersion liquid (A1) and 1250 parts by mass of ion-exchanged water, added were a polymerization initiator obtained by dissolving 10.3 parts by mass of potassium persulfate in 210 parts by mass of ion-exchanged-water, and monomers including 95.0 parts by mass of styrene, 2.0 parts by mass of methyl methacrylate, 2.0 parts by mass of methacrylic acid and 1.0 part by mass of 2-acrylamide-2-methylpropane sulfonic acid (namely, a compound represented by Formula (2)). The mixture was stirred while heating under a temperature condition of 80° C. for two hours to conduct polymerization. After the completion of polymerization, the product was cooled to 28 and, thus, Modified polyester resin particle dispersion liquid (B1) was prepared.

Modified polyester resin particle dispersion liquid (B1) was subjected to solid-liquid separation, and the weight average molecular weight of Modified polyester resin particles 1 was determined to be 27000.

—Preparation of Magenta Colorant Particle Dispersion Liquid—

| <Composition> | |
|---|---|
| C.I. Pigment Red 122 (produced by Clariant) | 50 mass parts |
| Ionic surfactant NEOGEN RK produced by Dai-ichi Kogyo Seiyaku Co., Ltd.) | 5 mass parts |
| De-ionized water | 195 mass parts |

The above materials were mixed and dissolved, and, further, dispersed for 10 minutes using a homogenizer (Ultratarax, manufactured by IKA Werke GmbH & Co. KG), whereby a magenta colorant particle dispersion liquid having a central diameter of the particles of 185 nm and a solid content of 20% by mass was obtained.

—Preparation of Releasing Agent Dispersion Liquid—

| <Composition> | |
|---|---|
| Paraffin wax FNP92 (melting point: 91° C., produced by NIPPON SEIRO CO., LTD.) | 50 mass parts |
| NEOGEN RK (produced by Dai-ichi Kogyo Seiyaku Co., Ltd.) | 5 mass parts |
| De-ionized water | 195 mass parts |

The above materials were heated at 60° C., and, after thoroughly dispersed with Ultratarax T50 (manufactured by IKA), further dispersed with a pressure ejection type Gaulin homogenizer, whereby a wax dispersion liquid having a central diameter of the particles of 70 nm and a solid content of 20% by mass was obtained.

Toner particles were prepared using above prepared materials via an aggregation method.

—Manufacture of Toner Particle 1—

| <Composition> | |
|---|---|
| Polyester resin particle dispersion liquid (A1) | 800 mass parts |
| Modified polyester resin particle dispersion liquid (B1) | 160 mass parts |
| Magenta colorant dispersion liquid | 60 mass parts |
| Releasing agent dispersion liquid | 60 mass parts |

The above materials were thoroughly mixed and distributed with Ultratarax T50 in a round bottom stainless steel flask.

Subsequently, 0.41 part by mass of poly aluminium chloride (produced by Asada Chemical INDUSTRY Co.LTD.) was added in the flask, and the dispersion treatment was continued with Ultratarax T50.

The flask was heated to 47° C. in an oil bath for heating while stirring, and then the temperature was kept at 47° C. for 60 minutes.

Then, after the inside pH value was adjusted to 8.0 at 47° C. using a 0.5 mol/L sodium hydroxide aqueous solution, the stainless steel flask was sealed and heated to 90° C. and then kept for 3 hours, while stirring was continued using a magnetic seal stirring system.

After the reaction was over, the product was subjected to cooling, filtering, washing thoroughly with de-ionized water, and solid-liquid separation with suction filtration using a Buchner funnel.

The solid content was further dispersed in 3 L of de-ionized water at 40° C. and stirred/washed for 15 minutes at 300 rpm.

This step was further repeated 5 times, and when the filtrate showed a pH value of 7.01, an electrical conductivity of 9.8 μS/cm and a surface tension of 71.1 N/m, the product was subjected to solid-liquid separation with a Buchner funnel filtration system using a filter paper No. 5A, and the solid content was dried at 40° C. for 12 hours under vacuum, whereby Toner particle 1 was obtained.

The volume median diameter D50 of Toner particle 1 was 5.4 μm.

—Manufacture of Toner Particle 2—

| <Composition> | |
|---|---|
| Polyester resin particle dispersion liquid (A1) | 800 mass parts |
| Magenta colorant dispersion liquid | 60 mass pasts |
| Releasing agent dispersion liquid | 60 mass pasts |

The above materials were thoroughly mixed and distributed with Ultratarax T50 in a round bottom stainless steel flask.

Subsequently, 0.41 part by mass of poly aluminium chloride (produced by Asada Chemical INDUSTRY Co., LTD.) was added in the flask, and the dispersion treatment was continued with Ultratarax T50.

The flask was heated to 47° C., in an oil bath for heating while stirring, and then the temperature was kept at 47° C. for 60 minutes.

Thereafter, 160 parts by mass of Modified polyester resin particle dispersion liquid (B1) was added, and the temperature was kept at 47° C. for further 30 minutes.

Then, after the inside pH value was adjusted to 8.0 at 47° C. using a 0.5 mol/L sodium hydroxide aqueous solution, the stainless steel flask was sealed and heated to 90° C. and then kept for 3 hours, while stirring was continued using a magnetic seal stirring system.

After the reaction was over, the product was subjected to cooling, filtering, washing thoroughly with de-ionized water, and solid-liquid separation with suction filtration using a Buchner funnel.

The solid content was further dispersed in 3L of de-ionized water at 40° C. and stirred/washed for 15 minutes at 300 rpm.

This step was further repeated 5 times, and when the filtrate showed a pH value of 7.01, an electrical conductivity of 9.8 μs/cm and a surface tension of 71.1 N/m, the product was subjected to solid-liquid separation with a Buchner funnel filtration system using a filter paper No. 5A, and the solid content was dried at 40° C. for 12 hours under vacuum, whereby Toner particle 2 was obtained.

The volume median diameter D50 of Toner particle 2 was 5.9 μm.

—Preparation of Modified Polyester Resin Particle Dispersion Liquid (B2)—

Modified polyester resin particle dispersion liquid (B2) was prepared in the same manner as the preparation of Modified polyester resin particle dispersion liquid (B1) except that 1.0 part by mass of the monomer 2-acrylamide-2-methylpropane sulfonic acid used in the preparation of Modified polyester resin particle dispersion liquid (B1) was replaced with 1.0 part by mass of a monomer represented by Formula (2) in which $R^1$=Me, $R^2$=Ph, M=Me.

Modified polyester resin particle dispersion liquid (B2) was subjected to solid-liquid separation, and the weight average molecular weight of Modified polyester resin particles 2 was determined to be 28000.

—Manufacture of Toner Particle 3—

Toner particle 3 was manufactured in the same manner as the Manufacture of Toner particle 1 except that Modified polyester resin particle dispersion liquid (B2) was used instead of Modified polyester resin particle dispersion liquid (B1). The volume median diameter D50 of obtained Toner particle 3 was 5.7 μm.

—Manufacture of Toner Particle 4—

Toner particle 4 was manufactured in the same manner as the Manufacture of Toner particle 2 except that Modified polyester resin particle dispersion liquid (B2) was used instead of Modified polyester resin particle dispersion liquid (B1). The volume median diameter D50 of obtained Toner particle 4 was 6.0 μm.

—Preparation of Modified Polyester Resin Particle Dispersion Liquid (B3)—

Modified polyester resin particle dispersion liquid (B3) was prepared in the same manner as the preparation of Modified polyester resin particle dispersion liquid (B1) except that 95.0 parts by mass of styrene, 2.0 parts by mass of methyl methacrylate and 2.0 parts by mass of methacrylic acid were not used, and 2.0 parts by mass of the monomer 2-acrylamide-2-methylpropane sulfonic was used instead of 1.0 part by mass of the monomer 2-acrylamide-2-methylpropane sulfonic acid.

Modified polyester resin particle dispersion liquid (B3) was subjected to solid-liquid separation, and the weight average molecular weight of Modified polyester resin particles 3 was determined to be 28000.

—Manufacture of Toner Particle 5—

Toner particle 5 was manufactured in the same manner as the Manufacture of Toner particle 1 except that Modified polyester resin particle dispersion liquid (B3) was used instead of Modified polyester resin particle dispersion liquid (B1). The volume median diameter D50 of obtained Toner particle 5 was 5.5 μm.

—Manufacture of Toner Particle 6—

Toner particle 6 was manufactured in the same manner as the Manufacture of Toner particle 2 except that Modified polyester resin particle dispersion liquid (B3) was used instead of Modified polyester resin particle dispersion liquid (B1). The volume median diameter D50 of obtained Toner particle 6 was 6.0 μm.

—Manufacture of Comparative Toner Particle 1 (Example to Prepare Vinyl Resin, First, to Add)—

Comparative Charge Controlling Resin C1

Into a reaction vessel capable of being pressurized equipped with a stirring device, a nitrogen inlet pipe, a temperature sensor and a rectifying column, charged were 1200 parts by mass of methyl ethyl ketone, 300 parts by mass of 2-propanol as solvents, and 95.0 parts by mass of styrene, 2.0 parts by mass of methyl methacrylate, 2.0 parts by mass of methacrylic acid and 1.0 part by mass of 2-acrylamide-2-methylpropane sulfonic acid as monomers, and the mixture was heated to a reflux temperature.

A solution obtained by dissolving one part by mass of t-butylperoxi-2-ethylhexanoate, which was a polymerization initiator, in 20 parts by mass of 2-butanone was added dropwise over 30 minutes, and stirred continuously for 5 hours to finish the reaction, whereby Comparative charge controlling resin C1 was obtained. The weight average molecular weight of Comparative charge controlling resin C1 was 20000.

Preparation of Comparative Polyester Resin Particle Dispersion Liquid (A2)

The obtained reaction liquid was cooled to 60° C., and 900 parts by mass of Polyester resin A1 was slowly added to be dissolved while stirring. Then, after adding 20 parts by mass of 10% aqueous ammonia to the product, 4500 parts by mass of de-ionized water was added using a metering pump while stirring, and, when the emulsion exhibited a milky white color and the viscosity while stirring became low, the emulsification was considered to be ended.

Subsequently, the emulsion liquid was transferred, by pumping up due to a pressure, difference based on centrifugal force, to a 3 liter separable flask equipped with stirring wings which forms a wet wall on the inner wall of the reaction vessel, a refluxing device and a depressurizing device using a vacuum pump, and the emulsion liquid was stirred under a condition of 58° C. of inner wall temperature of the reaction vessel and a reduced inside pressure of the reaction vessel of 8 kPa [abs]. The depressurizing was stopped when the refluxed amount reached 1950 parts by mass, the inside pressure was recovered to an ambient pressure, and the liquid was cooled to an ambient temperature while stirring. The volume median diameter of the resin particles dispersed in obtained Polyester resin particle dispersion liquid (A2) was 173 nm. The weight average molecular weight of the obtained resin particles dispersed in Polyester resin particle dispersion liquid (A2) was 11000.

Manufacture of Comparative Toner Particle 1

Comparative toner particle 1 was manufactured in the same manner as the Manufacture of Toner particle 1 except that 160 parts by mass of Modified polyester resin particle dispersion liquid (B1) was not used, but Comparative polyester resin particle dispersion liquid (A2) was used. The volume median diameter D50 of obtained Comparative toner particle 1 was 6.6 μm.

Manufacture of Comparative Toner Particle 2

Comparative toner particle 2 was manufactured in the same manner as the Manufacture of Toner particle 2 except that 160 parts by mass of Modified polyester resin particle dispersion liquid (B1) was not used, but Comparative polyester resin particle dispersion liquid (A2) was used. The volume median diameter D50 of obtained Comparative toner particle 2 was 6.7 μm.

[Evaluation]

For 100 parts by mass of each of obtained toner particles 1 to 6 and Comparative toner particles 1 and 2, 1.0 part by mass of hydrophobic silica was mixed using Henschel mixer at peripheral speed of the rotation wing of 24 m/s for 20 minutes, and each product was passed through a 400 mesh sieve.

Further, a ferrite carrier having been coated with a cyclohexyl methacrylate resin and having a volume median diameter of 60 μm was mixed so that the content of the toner was 6% by volume using a V-shape rotating mixer to obtain Developers 1 to 6 and Comparative developers 1 and 2.

The following evaluation was performed using the above Developers.

(a) Evaluation of Image Density Degradation Rate

In commercially available multi functional printer "bizhub PRO C6501" (produced by Konica Minolta Business Technologies, Inc.) used as an image forming apparatus, each developer was charged, and 10 sheets of entirely solid images (the amount of toner of 0.55 mg/cm$^2$) were formed for each developer. The degradation rate of the image density was measured by comparing the image densities of the first sheet and the 10th sheet.

Image density degradation rate=(Image density of the first sheet-Image density of the 10th sheet)/(Image density of the first sheet)×100

Evaluation was carried out according to the following criteria A, B, C and D,

A: Image density degradation rate was less than 5%, which is satisfactory for practical use.

B: Image density degradation rate was 5% or more, but less than 10%, which case no problem in practical use.

C: Image density degradation rate was 10% or more, but less than 15%, in which the possibility to cause a problem in practical use is low.

D: image density degradation rate was 15% or more, in which the possibility to cause a problem in practical use is high.

(b) Evaluation of Glossiness

Each developer was installed in a commercially available multi functional printer bizhub PRO C6501 (produced by Konica Minolta Business Technologies, Inc.) as an image forming apparatus, and a solid image having a toner amount of 1.2 mg/cm$^2$ was formed in which surface temperature of a heating device in a thermal roller fixing type of fixing device was set as 150° C., under the normal temperature and humidity conditions (temperature 20° C., humidity 50% RH), on a transfer material "POD GLOSSCOAT (128 g/m$^2$)" (produced by Oji paper Co., Ltd.). Glossiness of the solid image was measured and evaluated according to the following evaluation criteria. Glossiness of 60% or higher is acceptable.

The glossiness was measured, taking a standard of glass surface having a refractive index of 1.567 and angle of incidence of 75°, employing a gloss meter (GMX-203, produced by Murakami Color Research Laboratory Co., Ltd.).

Evaluation Criteria

Excellent: Glossiness is 70% or higher,

Good: Glossiness is 60% or higher but lower than 70%.

No good: Glossiness is lower than 60%.

TABLE 1

| Example | Toner | Developer | Image density degradation rate (%) | Glossiness (%) |
|---|---|---|---|---|
| Example 1 | Toner 1 | Developer 1 | 6 | 74 |
| Example 2 | Toner 2 | Developer 2 | 4 | 82 |
| Example 3 | Toner 3 | Developer 3 | 5 | 76 |
| Example 4 | Toner 4 | Developer 4 | 3 | 85 |
| Example 5 | Toner 5 | Developer 5 | 8 | 88 |
| Example 6 | Toner 6 | Developer 6 | 5 | 91 |
| Comparative example 1 | Comparative toner 1 | Comparative developer 1 | 16 | 64 |
| Comparative example 2 | Comparative toner 2 | Comparative developer 2 | 15 | 66 |

As is clear from the results demonstrated in Table 1, when an image was formed using a developer containing a toner of the present invention, the image density degradation rate was lower and the glossiness was higher, when compared with those of the comparative examples.

Namely, it was found that, according to the method of the present invention, a toner causing negligible reduction of the image density and providing high glossiness even in a high speed image forming apparatus can be provided.

Further, as is clear from the above examples, in the present invention, a highly productive method of manufacturing the toner can be obtained, since at least one step can be omitted by directly graftizing the structure represented by Formula (1a) or (1b) (which is a structural unit) to a polyester resin, or by introducing the structure as a crosslinking group. Also, the degree of freedom with respect to the introduced amount of the structure is high because the modification of the polyester can be conducted in an aqueous medium, whereby the degree of freedom with respect to the design regarding the adjustment of the charged amount is high.

What is claimed is:

1. A method of manufacturing a toner comprising a modified polyester resin containing a structure represented by Formula (1a) or (1b), the method comprising the steps of (a) dissolving a polyester resin in a solvent to form a polyester resin solution;

(b) dispersing the polyester resin solution in an aqueous medium, followed by removing the solvent to form a polyester resin particle dispersion liquid;

(c) adding a polymerizable monomer having a functional group selected from a group of a sulfonic acid group, a sulfonic salt group, and a sulfonic acid ester group, and a radical polymerization initiator the polyester resin particle dispersion liquid, followed by conducting radical polymerization to form a modified polyester resin particle dispersion liquid containing modified polyester resin particles; and (d) carrying out aggregation using at least the modified polyester resin particles to form particles of the toner, Formula (1a)

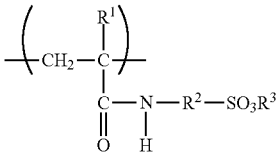

Formula (1b)

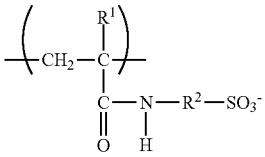

wherein, in Formula (1a) and (1b) R represents a hydrogen atom, a methyl group, or an ethyl group, $R^2$ represents an aliphatic hydrocarbon which may be branched, or an aromatic hydrocarbon, and $R^3$ represents a hydrogen atom, an alkyl group having 1 to 4 carbon atoms, or a phenyl group.

2. The method of claim 1, wherein Step (d) further comprises the steps of:

dispersing colorant particles in an aqueous medium to form a colorant particle dispersion liquid, mixing the modified polyester resin particle dispersion liquid and the colorant particle dispersion liquid, and aggregating the modified polyester resin particles and the colorant particles to form particles of the toner.

3. The method of claim 1, wherein the polyester resin is an unsaturated polyester resin, and the polvmerizable monomer is a compound represented by Formula (2), wherein 0.5 to 3 parts by mass of the compound represented by Formula (2) based on 100 parts by mass of the unsaturated polyester resin is used, Formula (2)

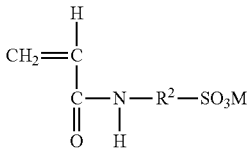

wherein, in Formula (2), $R^2$ represents an aliphatic hydrocarbon which may be branched or an aromatic hydrocarbon, and M represents an alkali metal, a hydrogen atom or a substituted or non-substituted hydrocarbon group.

4. The method of claim 1, wherein Step (d) further comprises the steps of:

forming the polyester resin particle dispersion liquid;

carrying out aggregation by adding an aggregation agent to the polyester resin particle dispersion liquid to form core particles, adding at least the modified polyester resin particle dispersion liquid prepared and an aggregation agent; and carrying out aggregation to form a shell layer on each core particle to form particles of the toner.

* * * * *